US007796921B2

(12) United States Patent
Tsuda et al.

(10) Patent No.: US 7,796,921 B2
(45) Date of Patent: Sep. 14, 2010

(54) IMAGE FORMING APPARATUS CAPABLE OF REDUCING AN OCCURRENCE OF DEVELOPER DEPLETION IN A DEVELOPMENT UNIT

(75) Inventors: Kiyonori Tsuda, Yokohama (JP); Satoru Yoshida, Sagamihara (JP); Hiroya Hirose, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 766 days.

(21) Appl. No.: 11/620,539

(22) Filed: Jan. 5, 2007

(65) Prior Publication Data

US 2007/0160392 A1 Jul. 12, 2007

(30) Foreign Application Priority Data

Jan. 5, 2006 (JP) ..... 2006-000603

(51) Int. Cl.
*G03G 15/08* (2006.01)

(52) U.S. Cl. ..... 399/256; 399/254

(58) Field of Classification Search ..... 399/265, 399/279, 254, 256
See application file for complete search history.

(56) References Cited

U.S. PATENT DOCUMENTS

| | | | | |
|---|---|---|---|---|
| 5,991,583 | A * | 11/1999 | Nozawa | 399/256 |
| 6,577,834 | B2 * | 6/2003 | Suzuki | 399/256 |
| 7,024,151 | B2 * | 4/2006 | Katoh et al. | 399/254 |
| 7,333,755 | B2 * | 2/2008 | Koido, Shigenori | 399/256 |
| 2005/0207793 | A1 * | 9/2005 | Ikeda et al. | 399/254 |
| 2005/0207794 | A1 * | 9/2005 | Katoh et al. | 399/254 |
| 2007/0014591 | A1 * | 1/2007 | Amano et al. | 399/254 |
| 2007/0025773 | A1 * | 2/2007 | Tateyama et al. | 399/254 |
| 2007/0041748 | A1 * | 2/2007 | Ikeda | 399/254 |
| 2007/0086812 | A1 * | 4/2007 | Iio et al. | |
| 2007/0264052 | A1 * | 11/2007 | Yoshida et al. | 399/254 |
| 2008/0025761 | A1 * | 1/2008 | Yoshida | 399/254 |

(Continued)

FOREIGN PATENT DOCUMENTS

| | | |
|---|---|---|
| JP | 11-133710 | 5/1999 |

(Continued)

OTHER PUBLICATIONS

U.S. Appl. No. 12/250,046, filed Oct. 13, 2008, Tsuda.

(Continued)

*Primary Examiner*—Susan S Lee
(74) *Attorney, Agent, or Firm*—Oblon, Spivak, McClelland, Maier & Neustadt, L.L.P.

(57) ABSTRACT

An image forming apparatus includes an electrostatic latent image carrier carrying an electrostatic latent image and a development unit that develops the electrostatic latent image. The development unit includes a developer carrier, first, second, and third developer conveyers, and an opening area. The developer carrier is disposed opposing to the electrostatic latent image carrier. The first developer conveyer supplies a developer to the developer carrier. The second developer conveyer conveys the developer, and transports the developer to the first developer conveyer at a downstream side of the second developer conveyer. The third developer conveyer collects the developer, conveys the developer, and transports the developer to the second developer conveyer in a downstream side of the third developer conveyer. The opening area, disposed higher than a lowermost point of the first developer conveyer, allows the developer to drop from the first developer conveyer to the second developer conveyer.

20 Claims, 6 Drawing Sheets

U.S. PATENT DOCUMENTS

2008/0038021 A1* 2/2008 Tsuda et al. ..... 399/254

FOREIGN PATENT DOCUMENTS

| | | |
|---|---|---|
| JP | 11-167260 | 6/1999 |
| JP | 2000-315016 | 11/2000 |
| JP | 2001-249545 | 9/2001 |
| JP | 2001-290368 | 10/2001 |
| JP | 2004-258237 | 9/2004 |

OTHER PUBLICATIONS

U.S. Appl. No. 12/015,803, filed Jan. 17, 2008, Hirose.
U.S. Appl. No. 12/019,984, filed Jan. 25, 2008, Tsuda, et al.
U.S. Appl. No. 12/020,172, filed Jan. 25, 2008, Tsuda, et al.
U.S. Appl. No. 12/042,848, filed Mar. 5, 2008, Kita, et al.
U.S. Appl. No. 12/059,392, filed Mar. 31, 2008, Tateyama, et al.
U.S. Appl. No. 12/110,055, filed Apr. 25, 2008, Sakata, et al.
U.S. Appl. No. 12/135,413, filed Jun. 9, 2008, Terai, et al.
U.S. Appl. No. 12/166,951, filed Jul. 2, 2008, Miyamoto, et al.
U.S. Appl. No. 11/836,298, filed Aug. 9, 2007, Tsuda, et al.
U.S. Appl. No. 12/238,815, filed Sep. 26, 2008, Utsunomiya, et al.
U.S. Appl. No. 11/853,490, filed Sep. 11, 2007, Miyamoto, et al.
U.S. Appl. No. 11/867,425, filed Oct. 4, 2007, Yoshida.

* cited by examiner

IMAGE FORMING APPARATUS CAPABLE OF REDUCING AN OCCURRENCE OF DEVELOPER DEPLETION IN A DEVELOPMENT UNIT

CROSS-REFERENCE TO RELATED APPLICATION

This patent application is based on Japanese patent application, No. 2006-000603 filed on Jan. 5, 2006 in the Japan Patent Office, the entire contents of which are incorporated by reference herein.

BACKGROUND OF INVENTION

1. Field of Invention

Exemplary aspects of the present invention relate to an image forming apparatus, and more particularly to an image forming apparatus employing a development unit including a developer carrying member and developer conveyance mechanisms.

2. Description of the Related Art

In general, an image forming apparatus of recent years has been demanded to enhance stability of an image quality without having density unevenness, etc. when images with high image area ratios are successively printed one after another.

A related art image forming apparatus has shifted configuration thereof by disposing a developer conveyance mechanism in a longitudinal direction instead of a lateral direction so as to meet the demand. This developer conveyance mechanism disposed in the longitudinal direction includes a first developer conveyer disposed in a lower side thereof to collect a developer from a developer carrying member after an image is developed. This developer conveyance mechanism also includes a second developer conveyer disposed in an upper side to supply the developer to the developer carrying member. In other words, the first and second developer conveyers are functionally separated, and the related art image forming apparatus has increased an agitation capability with respect to the developer. However, this related art image forming apparatus generates density unevenness and density reduction, which may be caused by insufficient agitation of the developer.

One example has attempted to modify the related art image forming apparatus by employing a related art development device shown in FIG. 1 that is capable of providing a quality image without the image unevenness.

Referring to FIG. 1, the related art development device includes a first conveyance path 227, a second conveyance path 228, and a third conveyance path 230. The first conveyance path 227, the second conveyance path 228, and the third conveyance path 230 include a surplus developer, a collected developer, and a circulating developer, respectively. The surplus developer from the first conveyance path 227 and the collected developer from the second conveyance path 228 are combined and agitated while conveying through the third conveyance path 230. The developer is combined and agitated as the circulating developer is circulated to the first conveyance path 227. This circulating developer has a relatively high toner density evenness, and the related art image forming apparatus with the related art development device may become capable of providing the quality image without the image unevenness when the image is formed with a high print density ratio. Therefore, the agitation capability with respect to the developer may be increased by having an additional developer conveyer of the third conveyance path 230 as a third developer conveyer.

Another example has attempted to employ another related art development device that includes a first auger housed in a first agitation space, a second auger housed in a second agitation space, a third auger housed in a third agitation space, a first division wall, and a first opening. The first auger supplies a developer to a developer carrying member, the second auger disposed below the first auger conveys the developer to a direction opposing to the first auger, and the third auger, disposed below the developer carrying member, conveys the developer to a direction opposing to the second auger. The first division wall separates the second and the third agitation spaces. The first opening is communicated with the second and the third agitation spaces in an end portion of the first division wall, and transfers the developer from a downstream side of a developer conveyance direction of the third auger to an upstream side of the second auger. Therefore, the developer is collected in the second agitation space after the image is developed. The developer is collected in one direction by the third auger, and is returned to the first agitation space when a toner is supplied.

SUMMARY OF THE INVENTION

According to an aspect of the invention, an image forming apparatus includes an electrostatic latent image carrier configured to carry an electrostatic latent image, and a development unit configured to develop the electrostatic latent image. The development unit includes a developer carrying member, a first developer conveyance mechanism, a second developer conveyance mechanism, a third developer conveyance mechanism, and an opening area. The developer carrying member is disposed opposing to the electrostatic latent image carrier. The first developer conveyance mechanism supplies a developer to the developer carrying member and conveys the developer in a first conveyance direction. The second developer conveyance mechanism is disposed below and oblique to the first developer conveyance mechanism. This second developer conveyance mechanism conveys the developer in a second conveyance direction that is substantially opposite to the first conveyance direction, and transports the developer obliquely upwards to the first developer conveyance mechanism at a downstream side of the second developer conveyance mechanism. The third developer conveyance mechanism collects the developer from the developer carrying member after an image is developed, and conveys the developer substantially in the first conveyance direction so as to transport the developer to the second developer conveyance mechanism at a downstream side of the third developer conveyance mechanism. The opening area is disposed at a position higher than a lowermost point of the first developer conveyance mechanism, and allows the developer to drop from the first developer conveyance mechanism to the second developer conveyance mechanism.

According to another aspect of the invention, a development unit includes a developer carrying member, a first developer conveyance mechanism, a second developer conveyance mechanism a third developer conveyance mechanism, and an opening area. The developer carrying member is disposed opposing to an electrostatic latent image carrier. The first developer conveyance mechanism supplies a developer to the developer carrying member and conveys the developer in a first conveyance direction. The second developer conveyance mechanism is disposed below and oblique to the first developer conveyance mechanism. The second developer conveyance mechanism conveys the developer in a second conveyance direction that is substantially opposite to the first conveyance direction, and transports the developer obliquely upward to the first developer conveyance mechanism in a downstream side of the second developer conveyance mechanism. The third developer conveyance mechanism collects the developer from the developer carrying member after a development is performed, and conveys the developer substantially in the first conveyance direction so as to transport the developer to the second developer conveyance mechanism at a downstream side of the third developer conveyance mechanism. The opening area is disposed at a position higher than a lowermost point of the first developer conveyance mechanism, and allows the developer to drop from the first developer conveyance mechanism to the second developer conveyance mechanism.

BRIEF DESCRIPTION OF THE DRAWINGS

A more complete appreciation of the exemplary aspects of the invention and many of the attendant advantage thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
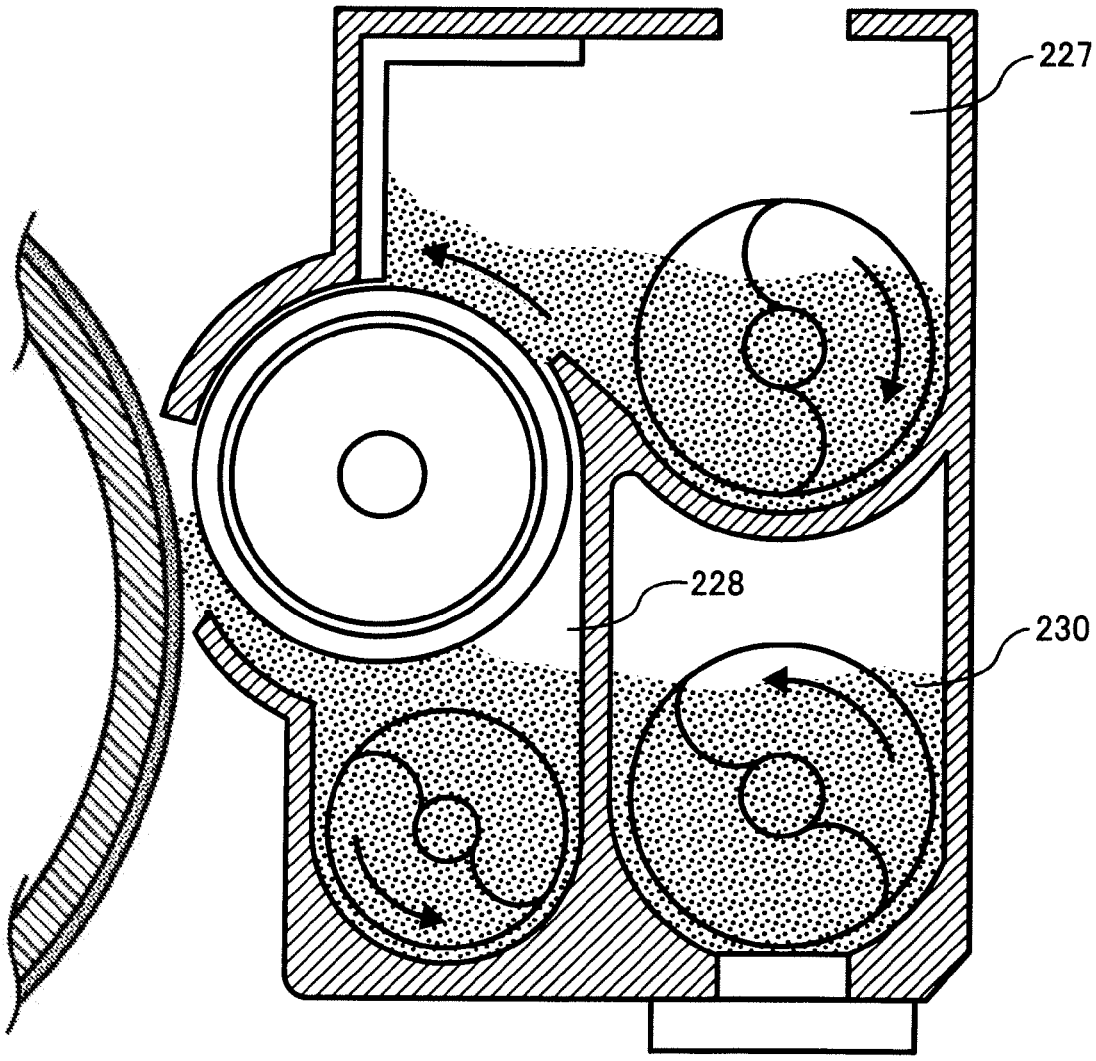
FIG. 1 BACKGROUND ART
FIG. 1 is a schematic cross sectional view illustrating a related art development device mounted in a related art image forming apparatus.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, an image forming apparatus according to an exemplary embodiment of the present invention is described.

Figure 2:
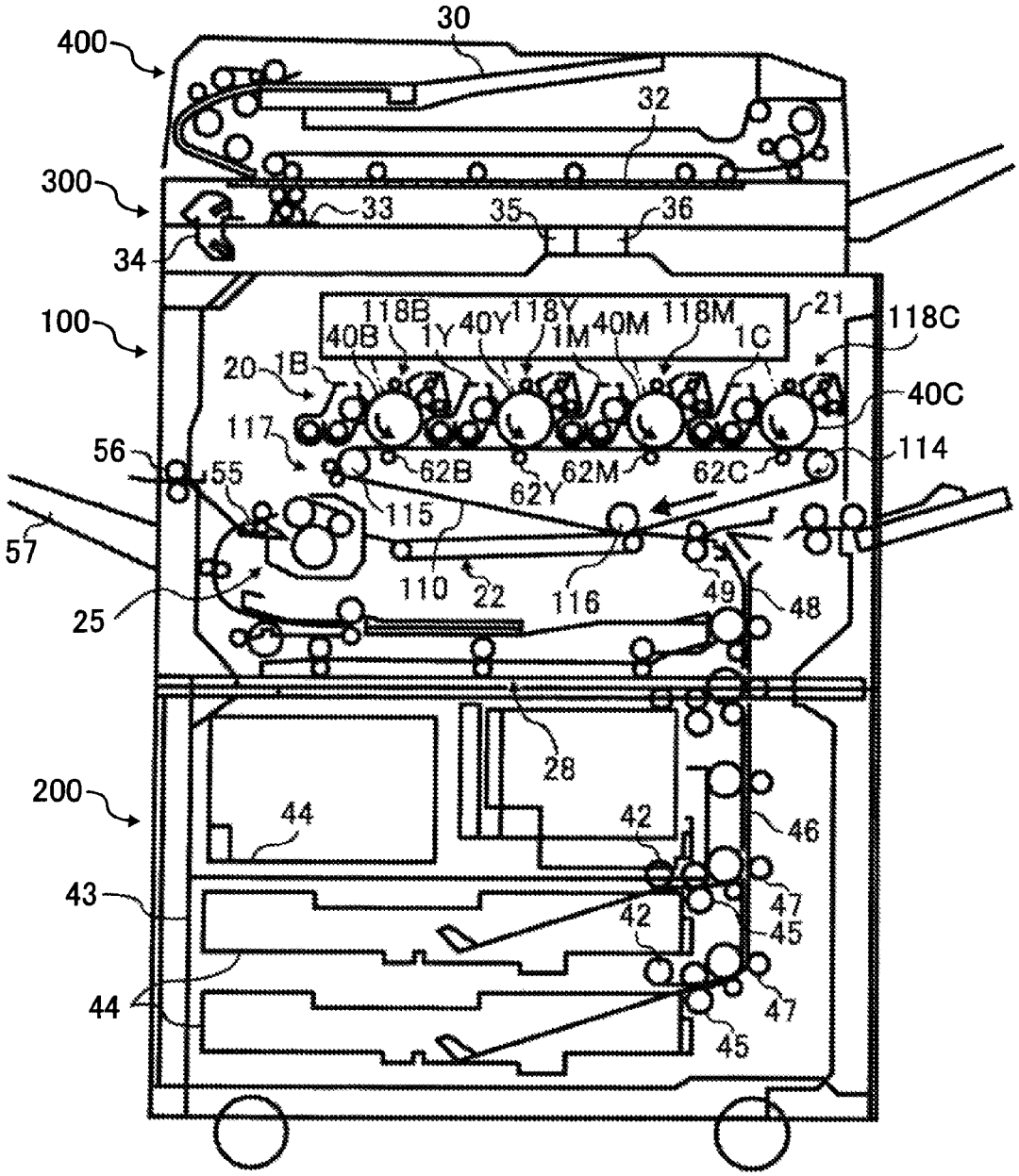
FIG. 2 is a schematic diagram illustrating an image forming apparatus according to an exemplary embodiment of the present invention.

Referring to FIG. 2, the image forming apparatus employing a tandem system to form a full color image by superimposing one color image on another with a plurality of image forming mechanisms is illustrated. This image forming apparatus includes an image forming device 100, a sheet feeding device 200, a reading optical device 300 (also called a scanner), and an automatic document feeder (ADF) 400.

The image forming device 100 configured to form the full color image includes a plurality of image forming elements such as an intermediate transfer member 110, a first support roller 114, a second support roller 115, a third support roller 116, a cleaning unit 117, an exposure unit 21, a secondary transfer unit 22, a fixing unit 25, a reversing unit 28, a feeding path 48, a pair of registration rollers 49, a switching tab 55, an ejection roller 56, an ejection tray 57, and a tandem image forming device 20. The tandem image forming device 20 includes four image forming mechanisms 118B, 118Y, 118M, and 118C for four primary colors of black, yellow, magenta, and cyan which are abbreviated as B, Y, M, and C, respectively. These abbreviations may be omitted as necessary. The image forming mechanism 118B includes a photoconductor 40B, a primary transfer unit 62B, and a development unit 1B. The image forming mechanism 118Y includes a photoconductor 40Y, a primary transfer unit 62Y, and a development unit 1Y. The image forming mechanism 118M includes a photoconductor 40M, a primary transfer unit 62M, and a development unit 1M. The image forming mechanism 118C includes a photoconductor 40C, a primary transfer unit 62C, and a development unit 1C.

The sheet feeding device 200 configured to feed a transfer sheet to the image forming device 100 includes a plurality of sheet feeding elements such as feeding rollers 42, a sheet bank 43, sheet cassettes 44, separation rollers 45, a conveyance path 46, and conveyance rollers 47.

The reading optical system 300 configured to scan an original includes a plurality of reading optical elements such as a contact glass 32, a first traveling body 33, a second traveling body 34, an image lens 35, and a reading sensor 36.

The automatic document feeder 400 configured to feed the original to the reading optical system 300 includes an original tray 30.

As stated above, the image forming device 100 includes the plurality of intermediate transfer elements as follows. The intermediate transfer member 110 is an endless belt on which a toner image is transferred. The first, the second, and the third support rollers 114, 115, and 116 support the intermediate transfer member 110 so that the intermediate transfer member 110 extends across these rollers, and can be conveyed rotationally in a clockwise direction as shown in FIG. 2. The cleaning unit 117 removes a remaining toner from the intermediate transfer member 110 after the toner image is transferred. The exposure unit 21 emits laser beams to the photoconductors 118B, 118C, 118Y, and 118M. The secondary transfer unit 22 secondarily transfers the toner image from the intermediate transfer member 110 onto the transfer sheet, and conveys the transfer sheet to the fixing unit 25. The fixing unit 25 fixes the toner image on the transfer sheet. The reversing unit 28 reverses front and back sides of the transfer sheet to form the toner images on both sides. The feeding path 48 feeds the transfer sheet from the sheet feeding device 200 to the pair of registration rollers 49. The pair of registration rollers 49 register the transfer sheet. The switching tab 55 switches a direction of the transfer sheet towards the ejection tray 57 or reversing unit 28. The ejection roller 56 ejects the transfer sheet. The ejection tray 57 is a tray on which the transfer sheet with the toner image is stacked. The tandem image forming device 20 forms the toner images with the image forming mechanisms 118B, 118Y, 118M, and 118C for the four primary colors. These image forming mechanisms 118B, 118Y, 118M, and 118C form the toner images of respective colors from electrostatic latent images formed on the photoconductors 40B, 40Y, 40M, and 40C. The photoconductors form the electrostatic latent images thereon by the laser beams emitted from the exposure unit 21. The primary transfer units 62B, 62Y, 62M, and 62C transfer the toner images from the photoconductors 40B, 40Y, 40M, and 40C onto the intermediate transfer member 110. The development units 1B, 1Y, 1M, and 1C develop the electrostatic latent images on the photoconductors 40 with toners.

As stated above, the sheet feeding device 200 includes the plurality of sheet feeding elements as follows. The feeding rollers 42 feed the transfer sheet. The sheet bank 43 includes the sheet cassettes 44. The sheet cassettes 44 stores the transfer sheet. The separation rollers 45 separate the transfer sheet, and feed the transfer sheet to the conveyance path 46. The conveyance path 46 is a path to convey the transfer sheet to the feeding path 48. The conveyance rollers 47 conveys the transfer sheet.

The reading optical system 300 includes the plurality of reading optical elements as follows. The contact glass 32 is a glass on which the original is placed. The first traveling body 33 emits a light from a light source to a surface of the original, and reflects a refection light reflected off the original surface towards the second traveling body 34 while traveling. The second traveling body 34 reflects the light with a mirror. The image lens 35 is a lens that the light reflected off the mirror of the second traveling body 34 passes through. The reading sensor 36 is a reading sensor to read the light.

The original tray 30 in the automatic document feeder 400 is a tray on which the original is placed.

As shown in FIG. 2, the image forming mechanisms 118B, 118Y, 118M, and 118C included in the tandem image forming device 20 are disposed side by side in positions above the intermediate transfer member 110 extending between the first support roller 114 and the second support roller 115. The cleaning unit 117 is disposed in a left side of the second support roller 115. The secondary transfer unit 22 is disposed below the intermediate transfer member 110 through which the secondary transfer unit 22 presses against the third support roller 116. The secondary transfer unit 22 and the fixing unit 25 are disposed next to each other. The reversing unit 28 is disposed below the secondary transfer unit 22 and the fixing unit 25, and is parallel to the tandem image forming device 20.

When a copy is made by using the image forming apparatus of FIG. 2, the original is placed on the original tray 30 in the automatic document feeder 400, or the original is placed on the contact glass 32 in the reading optical system 300. The reading optical system 300 is opened to place the original, and is closed to hold down the original. When the original is placed on the original tray 30, the original is conveyed on the contact glass 32 by pressing a start switch (not shown). The start switch drives the reading optical system 300, and allows the first and the second traveling bodies to travel. The first traveling body 33 irradiates the original surface on the contact glass 32 with the light, and reflects the light reflected off the original surface towards the second traveling body 34. The light is reflected off the second traveling body 34 with the mirror, and is passed through the image lens 35 so as to be read by the reading sensor 36. When the start switch is pressed, one of the three support rollers 114, 115, and 116 is rotated by a drive roller (not shown), and the other support rollers are rotated as driven rollers so that the intermediate transfer member 110 is rotationally conveyed. Simultaneously, the image forming mechanisms 118B, 118Y, 118M, and 118C rotate the photoconductors 40B, 40Y, 40M, and 40C, respectively, and form single color images with toners of black, yellow, magenta, and cyan on the photoconductors 40B, 40Y, 40M, and 40C, respectively. The single color images are sequentially transferred onto the intermediate transfer member 110 to form a full color image by superimposing one color image on another while conveying the intermediate transfer member 110.

On the other hand, one of the feeding rollers 42 included in the sheet feeding device 200 is selectively rotated, and the transfer sheet is provided from one of the sheet cassettes 44 included in the sheet bank 43 when the start switch is pressed. The transfer sheet is separated by the separation roller 45, is fed to the conveyance path 46, and is conveyed to the feeding path 48 included in the image forming device 100 by the conveyance rollers 47. When the transfer sheet abuts on the registration rollers 49, the transfer sheet stops. The registration rollers 49 rotate at a desired timing to the full color image on the intermediate transfer member 110, and the transfer sheet is fed to an area between the intermediate transfer member 110 and the secondary transfer unit 22 so that the secondary transfer unit 22 transfers the full color image from the intermediate transfer member 110 onto the transfer sheet. The secondary transfer unit 22 conveys the transfer sheet with the full color image to the fixing unit 25 in which a heat and a pressure are applied to fix the full color image. The transfer sheet with the fixed image is switched the direction thereof towards the ejection tray 57 or the reversing unit 28 by the switching tab 55. The transfer sheet is ejected by the ejection roller 56, and is stacked on the ejection tray 57. When the transfer sheet is led to the reversing unit 28 for transferring the images on both sides, the transfer sheet is reversed the direction thereof so as to be conveyed to a position in which the image is transferred on the reversed side of the transfer sheet. The transfer sheet having the images on both sides is ejected by the ejection roller 56, and is stacked on the ejection tray 57. When the toner images are transferred from the intermediate transfer member 110, the cleaning unit 117 removes the remaining toners from the intermediate transfer member 110 so that the tandem image forming device 20 prepares for a next image forming.

As stated above, the tandem image forming device 20 includes the image forming mechanisms 118B, 118Y, 118M, and 118C. Each of the image forming mechanisms 118B, 118Y, 118M, and 118C is configured to be similar to another, and each includes a charging unit (not shown), the development unit 1, the primary transfer unit 62, a photoconductor cleaner (not shown), and a discharge unit (not shown) in a vicinity of the photoconductor 40.

Figure 3:
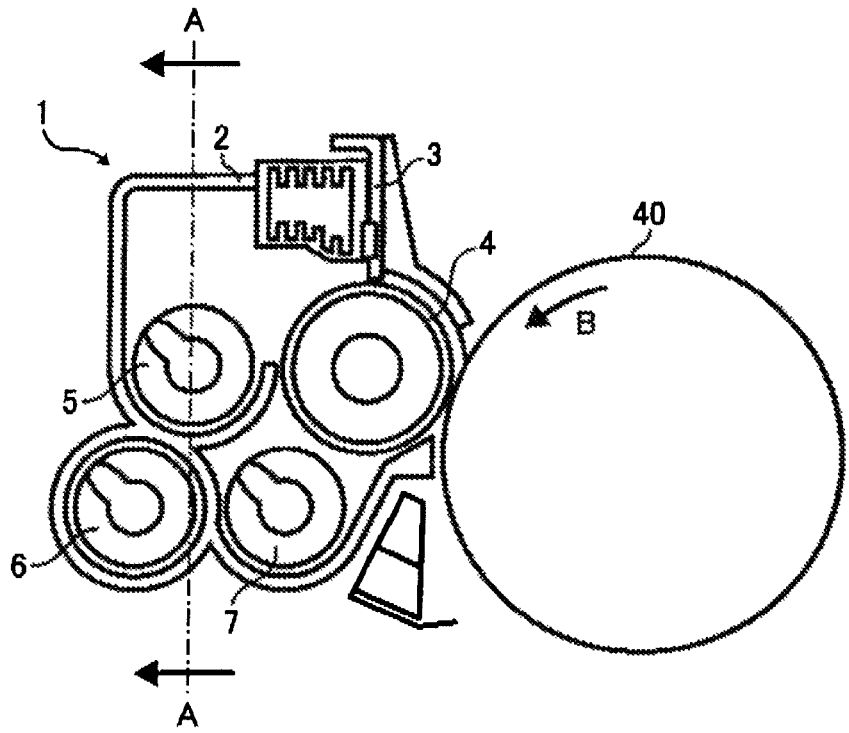
FIG. 3 is a schematic sectional view illustrating a development unit included in the image forming apparatus of FIG. 2.

Referring to FIG. 3, a development unit 1 that is representative of the development units 1B, 1Y, 1M, 1C included in one of the image forming mechanisms 118B, 118Y, 118M, and 118C in the image forming apparatus of FIG. 2, is enlarged and illustrated in a schematic sectional view.

The development unit 1 includes a development casing 2, a development doctor 3, a developer carrying member 4, a first developer conveyance mechanism 5, a second developer conveyance mechanism 6, and a third developer conveyance mechanism 7. The development unit 1, installed in the image forming apparatus, develops the electrostatic latent images on the photoconductor 40 with toner. The development casing 2 houses the development doctor 3, the developer carrying member 4, and the first, the second, and the third developer conveyance mechanisms 5, 6, and 7. The development doctor 3 can be a stainless doctor. The developer carrying member 4 carries the developer to the photoconductor 40. The first, the second, and the third developer conveyance mechanisms 5, 6, and 7 are configured to convey developing elements, for example, the developer and the toner.

When the development unit 1 develops the electrostatic latent image on the photoconductor 40 with the toner, the photoconductor 40 rotates in a direction B, represented by an arrow shown in FIG. 3, to charge a surface thereof with a charging roller (not shown). For example, the surface of the photoconductor 40 charged by the charging roller can be irradiated with the light emitted from the exposure unit 21 of FIG. 2 so as to form the electrostatic latent image thereon. The development unit 1 supplies the toner to the electrostatic latent image on the surface of the photoconductor 40 so as to form the toner image. The developer carrying mechanism 4 has a surface thereon that may include a V-groove or may be sandblasted. The developer carrying mechanism 4 may be an aluminum tube with a diameter of ϕ25 mm. The development unit 1 may include gaps between the developer carrying member 4 and the development doctor 3, and the developer carrying member 4 and the photoconductor 40. Each of the gaps can be approximately 0.3 mm.

Figure 7:
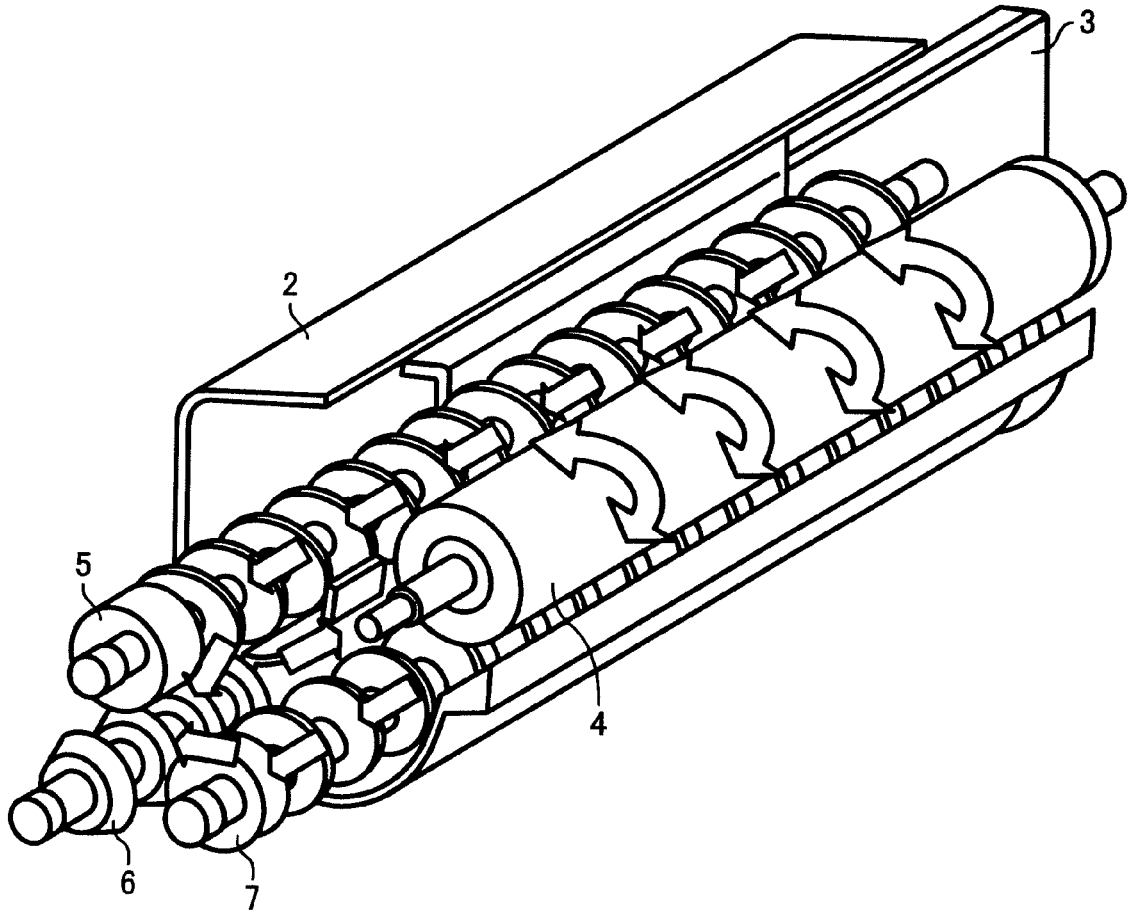
FIG. 7 is a schematic diagram illustrating a flow of a developer in the development unit included in the image forming apparatus of the exemplary embodiment of the present invention.

After the development unit 1 develops the electrostatic latent image with the toner, the third developer conveyance mechanism 7 collects remaining developer. As can be seen in FIG. 7, this remaining developer is conveyed towards a non-image forming area in which the second developer conveyance mechanism 6 has substantially no divider, and an appropriate amount of a toner is provided from an upper side of the second conveyance mechanism 6. The remaining developer and the appropriate amount of the toner are conveyed away from the non-image forming area by the second conveyance mechanism 6 while mixing the remaining developer and the toner. The second conveyance mechanism 6 has an opening in a vicinity of a downstream position thereof so that the remaining developer and the toner are transported from the second conveyance mechanism 6 to the first conveyance mechanism 5. In this way, the remaining developer and the toner are transported from a lower area to an upper area. Some of the remaining developer and the toner are supplied from the first developer conveyance mechanism 5, at an upstream side, to the developer carrying member 4, while a certain amount of the developer may be transported to the second developer conveyance mechanism 6 from an opening located in a vicinity of a downstream side of the second developer conveyance mechanism 6.

The development unit 1 can be installed in an image forming apparatus, for example, a copier and a laser printer. Each of the developer conveyance mechanisms 5, 6, and 7 may be configured to be a resin screw that may have a diameter of ϕ18 mm and a screw pitch of 25 mm, and may be rotated at approximately 600 rpm. A dashed line A-A with arrows indicates a cross section shown in FIG. 6.

Figure 4:
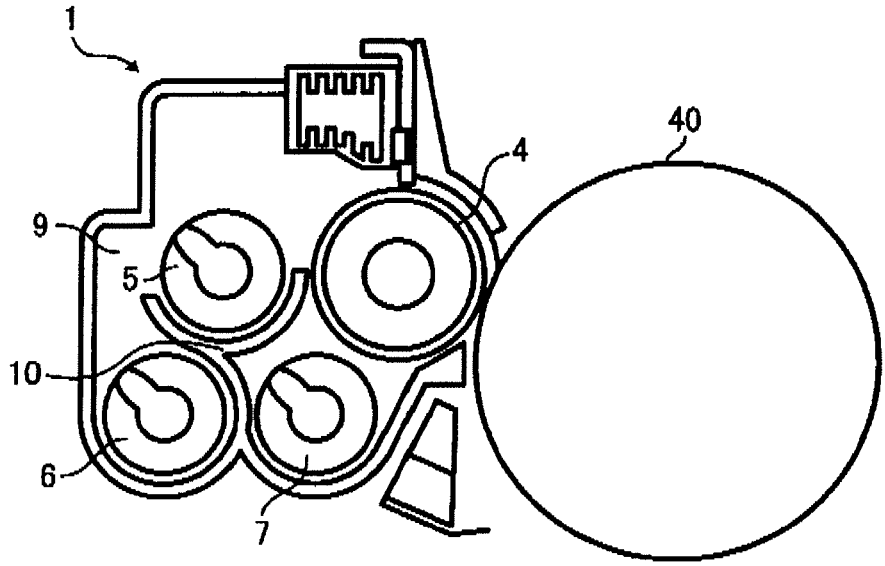
FIG. 4 is a schematic diagram illustrating another example configuration of the development unit of FIG. 3.

Referring to FIG. 4, another schematic diagram illustrates another example configuration of the development unit 1 shown in FIG. 3. As the development unit of FIG. 4 is similar to that of FIG. 3, except for a first opening area 9 and a low point 10, like reference numbers used in FIG. 4 and FIG. 3 designate corresponding parts.

The first opening area 9 is an opening to drop the developer from the first developer conveyance mechanism 5 to the second conveyance mechanism 6. The low point 10 is a point that is located substantially under a center of the first developer conveyance mechanism 5. The first opening area 9 is disposed in a position higher than the low point 10, for example, higher than a lowermost point of the first developer conveyance mechanism. Accordingly, the first developer conveyance mechanism 5 may become capable of holding a certain amount of the developer therein, and may reduce an occurrence of depleting the developer on the developer carrying member 4 caused by a shortage of the developer.

Figure 5:
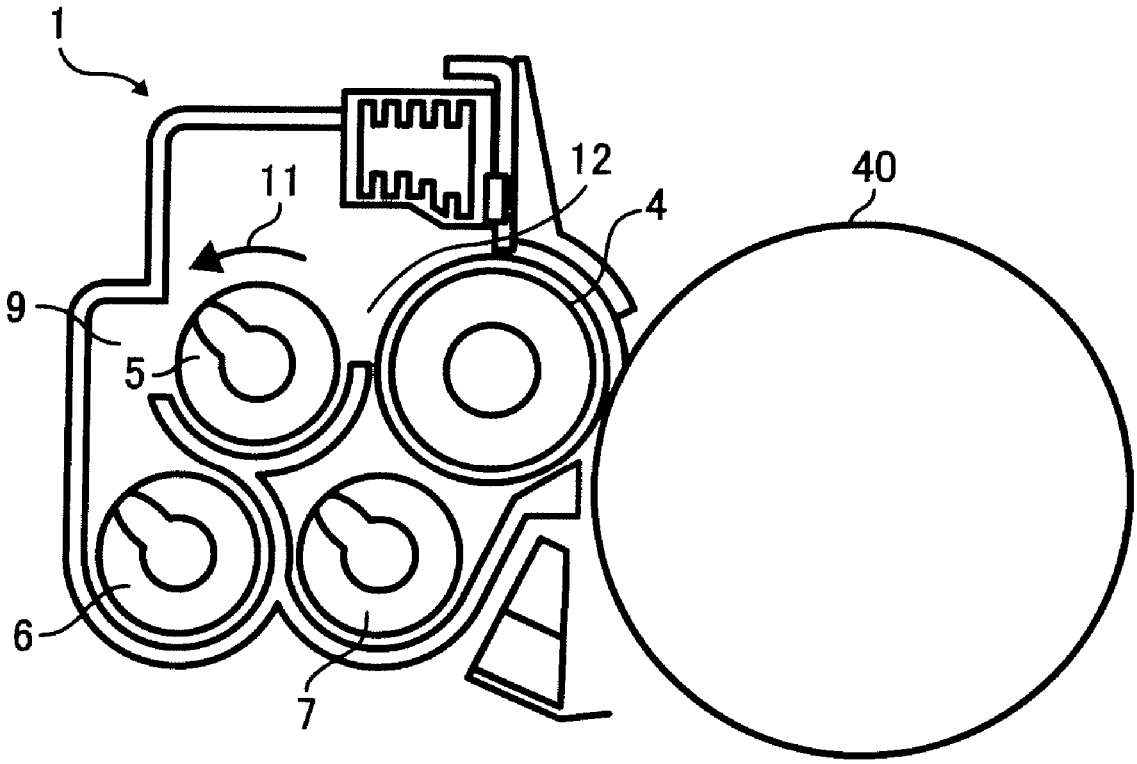
FIG. 5 is another schematic diagram illustrating another example configuration of the development unit of FIG. 3.

Referring to FIG. 5, still another schematic diagram illustrates another example configuration of the development unit 1 shown in FIG. 3 and FIG. 4. As the development unit of FIG. 5 is similar to that of FIG. 3 and FIG. 4, except for a rotation direction 11 and a second opening area 12, like reference numbers used in FIG. 3, FIG. 4, and FIG. 5 designate corresponding parts.

The first developer conveyance mechanism 5 is a rotation member, and rotates in the rotation direction 11 indicated by an arrow shown in FIG. 5. When the first developer conveyance mechanism 5 rotates in the rotation direction 11, the developer is dropped from the first opening area 9 disposed on a rotation direction side. This rotation direction side is opposite to a side that the developer is accumulated. Thereby, the first developer conveyance mechanism 5 becomes capable of holding a certain amount of the developer therein.

The first opening area 9,used to drop the developer, and the second opening area 12, used to supply the developer from the first developer conveyance mechanism 5 to the developer carrying member 4 are disposed opposite to each other. Accordingly, the first developer conveyance mechanism 5 may reduce an occurrence of dropping the developer when the developer is supplied, and may become capable of holding a creation amount of the developer therein.

Figure 6:
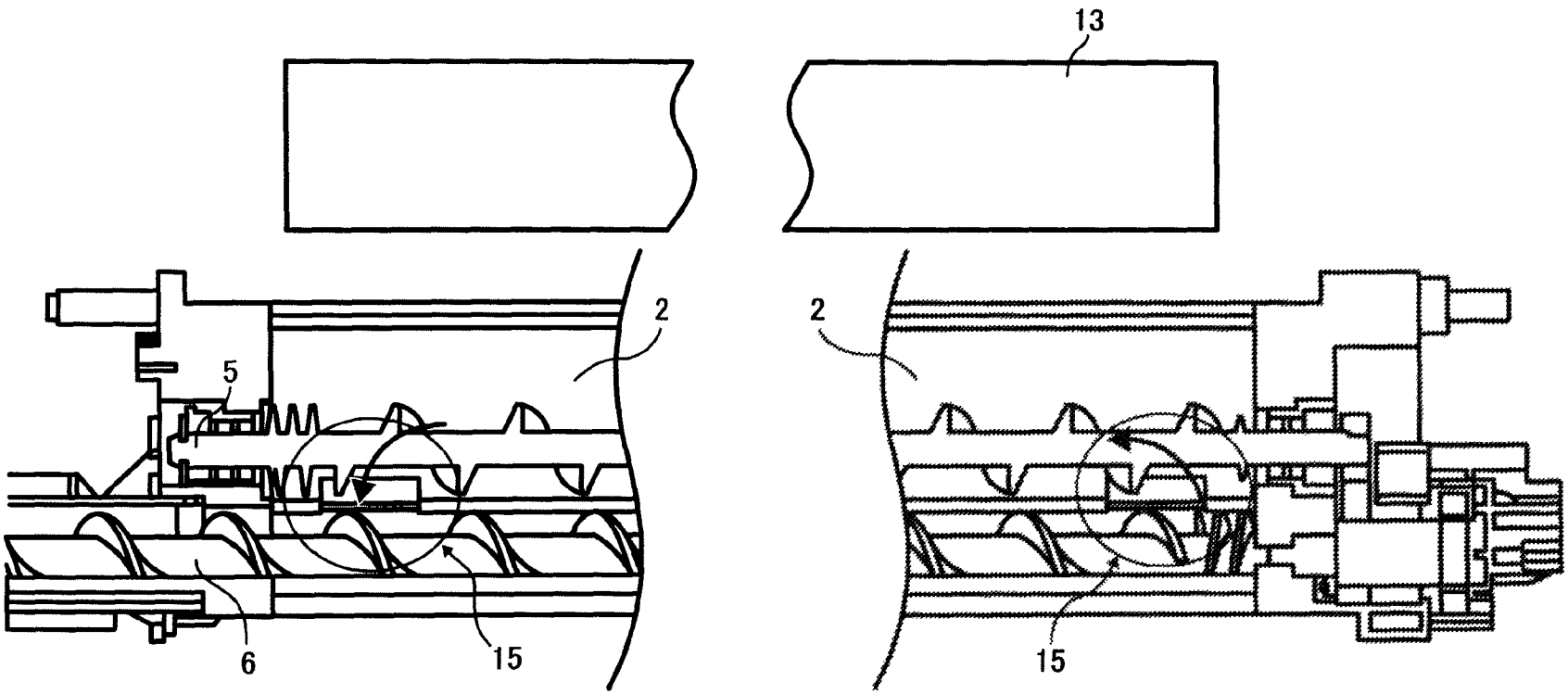
FIG. 6 is a schematic cross sectional view illustrating a delivery unit included in the development unit of FIG. 3.

Referring to FIG. 6, the development unit 1 of FIG. 3 includes a developer delivery area 15. The developer delivery area 15 is an area where the developer is transported from one area to another. An image forming region 13 is a region in which the image is formed.

FIG. 7 illustrates a flow of the developer in the development unit 1 included in the image forming apparatus of the exemplary embodiment of the present invention. A plurality of arrows in FIG. 7 illustrate the flow of the developer. The developer drops from the first developer conveyance mechanism 5 to the second developer conveyance mechanism 6 in the image forming region 13 of FIG. 6. Thereby, the development unit 1 may be decreased in size.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus, comprising:

an electrostatic latent image carrier configured to carry an electrostatic latent image; and a development unit configured to develop the electrostatic latent image, the development unit including a developer carrying member disposed opposite to the electrostatic latent image carrier, a first developer conveyance mechanism configured to supply a developer to the developer carrying member, and configured to carry the developer in a first conveyance direction, a second developer conveyance mechanism disposed below and oblique to the first developer conveyance mechanism, the second developer conveyance mechanism configured to convey the developer in a second conveyance direction that is substantially opposite to the first conveyance direction, and to transport the developer obliquely upwards to the first developer conveyance mechanism at a downstream side of the second developer conveyance mechanism, a third developer conveyance mechanism configured to collect the developer from the developer carrying member after an image is developed, and to convey the developer substantially in the first conveyance direction so as to transport the developer to the second developer conveyance mechanism at a downstream side of the third developer conveyance mechanism, and an opening area disposed at a position higher than a lowermost point of the first developer conveyance mechanism, and configured to allow the developer to drop from the first developer conveyance mechanism to the second developer conveyance mechanism.

2. The image forming apparatus of claim 1, wherein the first developer conveyance mechanism is not in direct contact with the developer carrying member.

3. The image forming apparatus of claim 1, wherein the third developer conveyance mechanism is disposed at a substantially same elevation as the second developer conveyance mechanism.

4. A development unit, comprising:

a developer carrying member configured to be disposed opposite to an electrostatic latent image carrier;

a first developer conveyance mechanism configured to supply a developer to the developer carrying member, and configured to convey the developer in a first conveyance direction;

a second developer conveyance mechanism disposed below and oblique to the first developer conveyance mechanism, the second developer conveyance mechanism configured to convey the developer in a second conveyance direction that is substantially opposite to the first conveyance direction, and to transport the developer obliquely upwards to the first developer conveyance mechanism at a downstream side of the second developer conveyance mechanism;

a third developer conveyance mechanism configured to collect the developer from the developer carrying member after a development is performed, and to convey the developer substantially in the first conveyance direction so as to transport the developer to the second developer conveyance mechanism at a downstream side of the third developer conveyance mechanism; and an opening area disposed in a position higher than a lowermost point of the first developer conveyance mechanism, and configured to allow the developer to drop from the first developer conveyance mechanism to the second developer conveyance mechanism.

5. The development unit of claim 4, wherein the first developer conveyance mechanism is not in direct contact with the developer carrying member.

6. The development unit of claim 4, wherein the third developer conveyance mechanism is disposed at a substantially same elevation as the second developer conveyance mechanism.

7. The development unit of claim 4, wherein the first developer conveyance mechanism is a rotating body, and the opening area is disposed at a side of the first developer conveyance mechanism that is opposite to the side of the first developer conveyance mechanism that is closest to the developer carrying member.

8. The development unit of claim 4, wherein the opening area is disposed at a portion of the first developer conveyance mechanism that is opposite to a portion of the first developer conveyance mechanism where a second opening area from which the first developer conveyance mechanism supplies the developer to the developer carrying member is disposed.

9. The development unit of claim 4, wherein the opening area is located within an image forming region of the development unit.

10. A development unit, comprising:

a developer carrying member configured to be disposed opposite to an electrostatic latent image carrier;

a first developer conveyance mechanism that supplies a developer to the developer carrying member;

a second developer conveyance mechanism disposed below and oblique to the first developer conveyance mechanism that transports the developer obliquely upwards to the first developer conveyance mechanism at a downstream side of the second developer conveyance mechanism;

a third developer conveyance mechanism that collects the developer from the developer carrying member after a development is performed and that transports the developer to the second developer conveyance mechanism at a downstream side of the third developer conveyance mechanism; and means for allowing the developer to drop from the first developer conveyance mechanism to the second developer conveyance mechanism, wherein the means for allowing the developer to drop is disposed in a position higher than a lowermost point of the first developer conveyance mechanism.

11. The development unit of claim 10, wherein the first developer conveyance mechanism is not in direct contact with the developer carrying member.

12. The development unit of claim 10, wherein the third developer conveyance mechanism is disposed at a substantially same elevation as the second developer conveyance mechanism.

13. The development unit of claim 10, wherein the first developer conveyance mechanism is a rotating body, and the means for allowing is disposed at a first side of the first developer conveyance mechanism in a radial direction of the first developer conveyance mechanism that is opposite to a second side of the first developer conveyance mechanism in the radial direction of the first developer conveyance mechanism that is closest to the developer carrying member.

14. The development unit of claim 10, wherein the means for allowing is disposed near a portion of the first developer conveyance mechanism that is radially opposite to a portion of the first developer conveyance mechanism where an opening area from which the first developer conveyance mechanism supplies the developer to the developer carrying member is disposed.

15. The development unit of claim 10, wherein the means for allowing is located within an image forming region of the development unit.

16. The development unit of claim 10, wherein the first developer conveyance mechanism conveys the developer in a first conveyance direction, the second developer conveyance mechanism conveys the developer in a second conveyance direction that is substantially opposite to the first conveyance direction, and the third developer conveyance mechanism conveys the developer substantially in the first conveyance direction.

17. An image forming apparatus, comprising:

an electrostatic latent image carrier configured to carry an electrostatic latent image; and a development unit configured to develop the electrostatic latent image, the development unit including a developer carrying member disposed opposite to the electrostatic latent image carrier, a first developer conveyance screw configured to supply a developer to the developer carrying member, and configured to carry the developer in a first conveyance direction, a second developer conveyance screw disposed below and oblique to the first developer conveyance screw, the second developer conveyance screw configured to convey the developer in a second conveyance direction that is substantially opposite to the first conveyance direction, and to transport the developer obliquely upwards to the first developer conveyance screw at a downstream side of the second developer conveyance screw, a third developer conveyance screw configured to collect the developer from the developer carrying member after an image is developed, and to convey the developer substantially in the first conveyance direction so as to transport the developer to the second developer conveyance screw at a downstream side of the third developer conveyance screw, a passage that receives the first developer conveyance screw, and an opening area disposed at a position higher than a lowermost point of the passage, and configured to allow the developer to drop from the first developer conveyance screw to the second developer conveyance screw.

18. The image forming apparatus of claim 17, wherein the opening area is located at a side of the passage where a blade edge of the first developer conveyance screw travels downwards during rotation.

19. The image forming apparatus of claim 18, wherein the opening area is located at an opposite side of the passage from an opening area of the passage through which the developer from the first developer conveyance screw is transported to the developer carrying member.

20. The image forming apparatus of claim 18, wherein the opening area is disposed near an end of the passage in an axial direction of the first developer conveyance screw.

* * * * *